United States Patent [19]

Grass

[11] Patent Number: 4,535,502

[45] Date of Patent: Aug. 20, 1985

[54] METHOD OF FABRICATING A BASE PLATE FOR A METAL FITTING, AND STAMPING UTILIZED IN FORMING THE BASE PLATE

[76] Inventor: Alfred Grass, Konsumstrasse 20, A-6973 Höchst, Austria

[21] Appl. No.: 530,857

[22] Filed: Sep. 9, 1983

[30] Foreign Application Priority Data

Sep. 9, 1982 [DE] Fed. Rep. of Germany ..... 3233512

[51] Int. Cl.[3] ..... B21D 53/36

[52] U.S. Cl. ..... 16/382; 29/150; 72/379

[58] Field of Search ..... 72/324, 326, 379, 404; 29/11, 150; 16/124, 125, 382, 388, 387, 390, 391, 392; 248/300

[56] References Cited

U.S. PATENT DOCUMENTS

| | | | |
|---|---|---|---|
| 946,536 | 1/1910 | Cromleigh | 16/384 |
| 1,052,892 | 2/1913 | Cranzler | 16/390 |
| 1,640,525 | 8/1927 | Belliveau | 16/390 |
| 1,691,109 | 11/1928 | Carpenter | 29/11 |
| 2,231,909 | 2/1941 | Hempel | 16/382 |
| 2,249,731 | 7/1941 | Gilstrap | 16/125 |

*Primary Examiner*—Lowell A. Larson
*Attorney, Agent, or Firm*—Boniard I. Brown

[57] ABSTRACT

A method and stamping for fabricating a base plate are provided, the method comprising the provision of a metal stamping and bending end portions of the stamping at two spaced lines perpendicular to the longitudinal axis of the stamping to define leg portions and mutually parallel guide plate portion and end mounting portions, in a single-pass bending operation. L-shaped cuts are preferably provided at each end portion in opposite edges to define the leg portions and to define tab portions which are extended under the guide plate portion by the bending operation.

11 Claims, 10 Drawing Figures

METHOD OF FABRICATING A BASE PLATE FOR A METAL FITTING, AND STAMPING UTILIZED IN FORMING THE BASE PLATE

BACKGROUND OF THE INVENTION

Base plates of the types provided by the invention are utilized in the mounting of fittings, particularly in the mounting of hinge arms to items of furniture, doors, etc. Such fittings are conventionally fabricated in one piece from zinc die-castings. The fittings thus fabricated are quite expensive, and the production or fabrication costs are high.

It is therefore an object and advantage of the invention to provide a method and a stamping for the fabrication of such base plates from inexpensive material by an inexpensive process. An object of the invention is the provision of a stamping well-adapted to the fabrication of such base plates.

In fulfilling this task, the invention is characterized in that a rectangular stamping is punched out of sheet iron and bent at right angles to its longitudinal axis at two spaced lines at each end portion, producing the U-shaped form with the outwardly extending mounting end portions.

An object and advantage of the invention is the forming of the base plate from the stamping in a single pass of the forming device to accomplish the bending at both end portions of the stamping.

SUMMARY OF THE INVENTION

The present invention relates generally to a method and a stamping for the fabrication of the base plate which is adapted to receive a fitting of a hinge arm. The method involves the provision of a metal stamping having a longitudinal axis, and the bending of opposite end portions of the stamping at spaced parallel lines normal to the longitudinal axis, thereby defining leg portions, an upper guide plate portion and end mounting portions which are parallel to the guide plate portion. All the bending is preferably effected in a single-pass bending operation. Preferably, L-shaped cuts are provided in the opposite edge portions of each end portion of the stamping, each such cut having a portion parallel to and a portion perpendicular to the axis, thus defining the leg portions and defining tab portions which are extended by the bending operation under the guide plate portion. In another form, U-shaped cuts are defined in the opposite edge portions at each end portion to define the leg portions of narrower width than the guide plate portion.

DESCRIPTION OF THE PREFERRED EMBODIMENT

It is preferred that, prior to or concurrently with bending, cuts are made in the stamping, which facilitate bending along the specified lines and which define the bending lines.

Depending on the exact construction of the base plate to be fabricated, there are several stampings to implement this process. A first embodiment is characterized in that the stamping has cut-outs with L-shaped edges, forming the tabs and the legs of the U-shaped profile.

Figure 2:
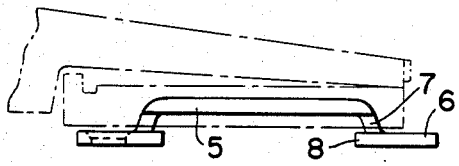
FIG. 2 is an elevational view of a base plate for a metal fitting, formed from the stamping of FIG. 1.

If it is desired that the guide plate portion extend over inner or tab portions of the end mounting portions, L-shaped cuts are made or defined in the stamping, which serve to define the leg portions and to define tab portions of the end mounting portions, which tab portions are urged to their positions shown in FIG. 2, wherein they extend under the guide plate portion, upon the bending operation at the spaced lines at each end portion of the stamping.

In many applications it is preferred that the space between the legs of the U-shaped profile be essentially filled with another material. For this purpose it is preferred that a plastic part be inserted into the bent stamping which essentially fills the space between the legs of the U-shaped profile.

It is preferred that the plastic part have an inverted T-shaped cross-sectional profile, with its base on the bottom. Together with the base of the U-shaped profile, this forms an H-shaped cross-sectional profile whose lateral longitudinal grooves may serve to hold the ends of a hinge part or the like.

Figure 1:
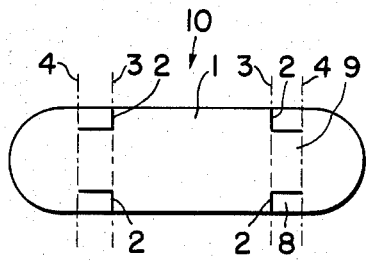
FIG. 1 is a plan view of a stamping utilized in accordance with a first embodiment of the invention.

As shown in FIG. 1, the base plate is formed from a sheet iron stamping of generally rectangular or oval form. By means of a punch die, four similar L-shaped cuts are defined or made in the opposite edge portions of each end portion of the stamping. This defines two different bending lines 3, 4 at each side of the stamping 1.

The upper guide plate portion 5 is then clamped by a bending tool, and the mounting portions 6 are pressed down perpendicularly to the plane of the paper as viewed in FIG. 1, producing the base plate form illustrated in FIG. 2. It is essential that, due to the L-shaped cuts 2, grooves 7 at the lower edge of the guide plate at the transition to the mounting surface break out, producing the lower tabs 8 lying in the plane of the mounting portions 6.

Figure 3:
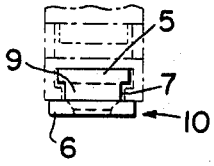
FIG. 3 is an end view of the base plate of FIG. 1.
Figure 4:
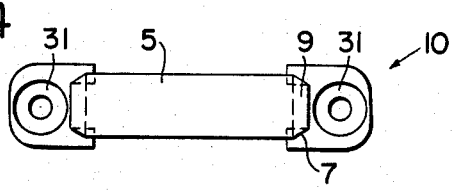
FIG. 4 is a plan view of the base plate of FIG. 2.

FIG. 4 shows the top view of the completely bent piece in accordance with FIG. 2, while FIG. 3 shows the end view.

A member such as a hinge arm is then urged onto the base plate by urging a U-shaped or C-shaped mounting plate portion of the hinge onto the base plate while the opposing prongs of the C-shaped mounting plate engage in grooves 7 defined in the base plate (FIG. 3). It is essential that the grooves 7 be situated only in the region between the mounting portions 6 and guide plate portion 5.

Figure 5:
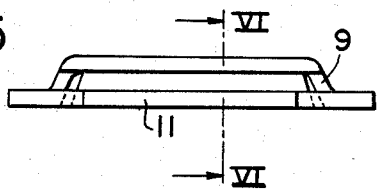
FIG. 5 is an elevational view of the base plate of FIG. 2, showing an insert mounted in the base plate.
Figure 6:
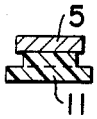
FIG. 6 is a sectional end view taken at the line VI in FIG. 5.

FIG. 5 and FIG. 6 illustrate utilization of a plastic component 11 which is inserted or fitted between the end mounting portions to fill the potentially unsightly space between the guide plate portion and the mounting end portions. This plastic part 11 also improves guidance of the mounting plate of a hinge arm as it is pushed onto this base plate 10.

Figure 7:
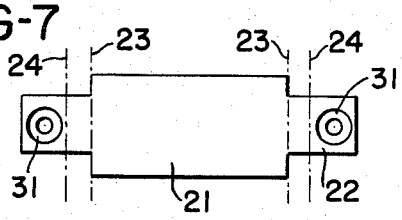
FIG. 7 is a plan view of a stamping according to a second embodiment of the invention.
Figure 8:
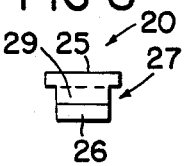
FIG. 8 is an end view of a base plate formed from the stamping of FIG. 7.

A second embodiment of the invention is illustrated in FIGS. 7 and 8. A simplified stamping 21 has cut-out portions to define end portions 21. The bending edges 23, 24 are defined where the bending tool attaches and, upon completion of the bending process, gives the base plate 20 the form shown in FIG. 8. It is essential in this case that no definite groove is formed; the guide plate 25 is merely wider than the lower mounting surface 26. The web 29 is of the same width as the mounting surface 26, while in the previously described embodiment the web 9 has a narrower width compared with the width of the guide plate and the width of the mounting surface 6. Although there is no groove like the groove 7 of the embodiment of FIGS. 1 through 5, wherein the legs 9 are narrower than the guide plate and the end mounting portions, the essential function of such groove is provided because the mounting plate has a generally C-shaped configuration which engages about the guide plate 25.

Figure 10:
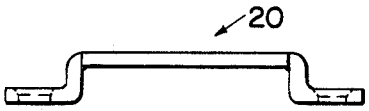
FIG. 10 is an elevational view of a base plate formed from the stamping of FIG. 9.
Figure 9:
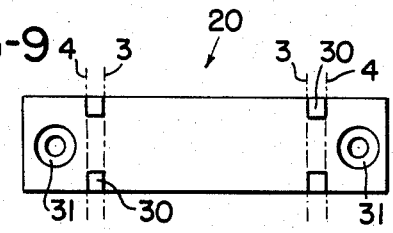
FIG. 9 is a plan view of a stamping according to a third embodiment of the invention.

A third embodiment is illustrated in FIGS. 9 and 10, and is similar in many respects to the embodiment of FIG. 1, but utilizes a stamping having U-shaped cut-outs 30 instead of the L-shaped cuts 2 of FIG. 1. That is, the cuts are completed to define a U-shaped cut-out. The tabs 8 of FIG. 2 are therefore not formed as shown in FIG. 10.

FIGS. 4, 7 and 9 illustrate the provision of mounting holes 31 in the end mounting surfaces 6.

While the invention has been disclosed in connection with certain physical embodiments thereof, it will be recognized by those versed in the art that various modifications of the invention are possible within the spirit and scope of the following claims.

I claim:

1. A method of fabricating a base plate adapted to receive a fitting of C-shaped cross-section, and having a longitudinal axis and generally U-shaped configuration with outwardly extending lower end mounting portions, a guide plate protion spaced from and generally parallel to the end mounting portions, leg portions perpendicular to and interconnecting the end mounting portions and the guide plate portion, said guide plate portion being wider than the legs transversely of the longitudinal axis to define therewith a T-shaped cross-section, said method comprising:

providing a metal stamping having a longitudinal axis, and bending opposite end portions of said stamping at two spaced lines extending at right angles to the longitudinal axis to define said legs, guide plate portion and end mounting portions.

2. The method according to claim 1, wherein:

said bending is effected in one single-pass bending operation.

3. The method according to claim 1 and further including:

making an L-shaped cut in each opposite edge portion at each end portion of the stamping, each of said L-shaped cuts having a portion parallel to said axis and a portion perpendicular to said axis, thus defining tab portions which are extended inwardly under said guide plate portions upon said bending to define said leg portions and end mounting portions.

4. The method according to claim 3, wherein:

said bending and the making of said L-shaped cuts are effected in a single-pass operation.

5. The method according to claim 1, and further including:

defining a U-shaped cut in each opposite edge portion at each end portion of the stamping to define said leg portions of narrower width than the guide plate portion and end mounting portions.

6. The method according to claim 5, wherein:

said bending and said defining of U-shaped cut-outs are effected in a single-pass operation.

7. A stamping for fabricating, by bending at two spaced lines at each opposite end portion, a base plate adapted to receive a fitting of C-shaped cross-section, and having a longitudinal axis and generally U-shaped configuration with outwardly extending end mounting portion, leg portions, and a guide plate portion spaced from and generally parallel to the end mounting portions, said stamping comprising:

a flat stamping body of generally rectangular configuration, means defining an L-shaped cut in each opposite edge portion at each end portion of the stamping, each such cut including a cut portion parallel to and a cut portion at right angles to the longitudinal axis, thereby defining said leg portions and defining tabs extending inwardly of the end mounting portions upon said bending to define the legs and end mounting portions, and a component inserted between said end mounting portions substantially to fill the space defined between the leg portions of the U-shaped base plate formed from the stamping.

8. A stamping according to claim 7, wherein:

said component has the general cross-sectional configuration of an inverted "T".

9. A base plate having a longitudinal axis and being adapted to slidably receive a fitting of C-shaped cross-section, said base plate having lower outwardly extending end mounting portions, leg portions generally perpendicular to the end mounting portions, and an upper guide plate portion spaced from and generally parallel to the end mounting portions, said guide plate portion being wider than the legs transversely of the longitudinal axis to define therewith a T-shaped cross-section, said base plate being formed by providing a stamping and bending opposite end protions of said stamping at two spaced lines extending at right angles to said longitudinal axis to define said leg portions, said guide plate portion and said end mounting portions.

10. A base plate according to claim 9, wherein:

said base plate is formed by defining in each opposite edge portion at each end portion of a generally rectangular flat stamping body an L-shaped cut extending parallel to and at right angles to said longitudinal axis, and each of said L-shaped cuts defined a tab which is urged inwardly to extend under one of said end mounting portions during said bending to define the leg portions and the end mounting portions.

11. A base plate according to claim 9, wherein:

the base plate is formed by defining a U-shaped cut in each opposite edge portion at each end portion of the flat stamping body to define said leg portions of narrower width than the guide plate portion and the end mounting portions.

* * * * *